United States Patent [19]

Saint

[11] 4,452,446

[45] Jun. 5, 1984

[54] BATTERY-OPERATED CHILD'S SWING

[75] Inventor: David Saint, Elverson, Pa.

[73] Assignee: Graco Metal Products, Inc., Elverson, Pa.

[21] Appl. No.: 429,747

[22] Filed: Sep. 30, 1982

[51] Int. Cl.[3] ..... A63G 9/16

[52] U.S. Cl. ..... 272/86

[58] Field of Search ..... 272/86, 85

[56] References Cited

U.S. PATENT DOCUMENTS

| | | | |
|---|---|---|---|
| 2,564,547 | 8/1951 | Schrougham | 272/86 |
| 2,807,309 | 9/1957 | Saint et al. | 272/86 |
| 3,128,076 | 4/1964 | Di Pasqua | 272/86 |
| 3,146,985 | 9/1964 | Grudoski | 248/370 |
| 4,150,820 | 4/1979 | Bochmann | 272/86 |

FOREIGN PATENT DOCUMENTS

| | | |
|---|---|---|
| 497871 | 9/1954 | Italy . |
| 1070921 | 6/1967 | United Kingdom . |

*Primary Examiner*—William H. Grieb

*Attorney, Agent, or Firm*—Seidel, Gonda & Goldhammer

[57] ABSTRACT

A battery-operated child's swing is driven by a motor with a worm mounted on the motor shaft. The worm drives a gear, on which is mounted a crank. The end of the crank is constrained in one sleeve of a two-way slider. A second sleeve of the slider, which is mounted at right angles to the first sleeve, receives one end of an over-travel torque spring. When the motor is energized, the worm turns the gear which drives the crank. The crank, via the slider, puts side pressure on the over-travel torque spring, directed first toward the front of the swing and then toward the rear of the swing. The force is applied above the horizontal pivot line of the swing carriage and causes a rocking motion in the carriage. The over-travel torque spring is stiff enough to transmit the driving force from the crank to the swing carriage while being resilient enough to twist, if necessary, due to stoppage of the motor to prevent damage to the mechanism in the event that the motor is stopped while the carriage is still swinging.

12 Claims, 7 Drawing Figures

FIG. 1
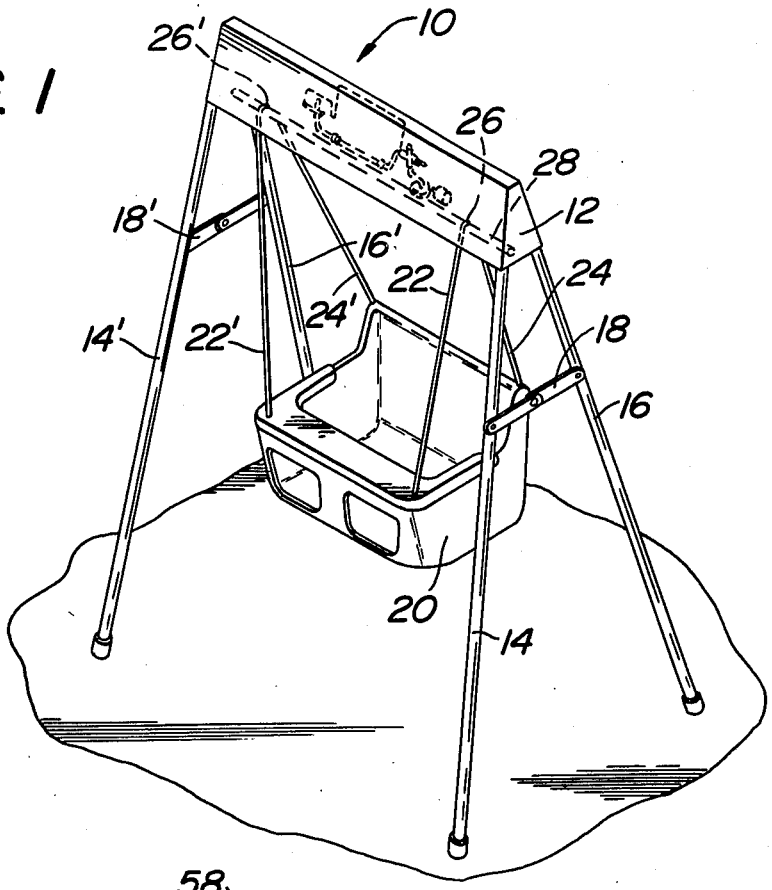
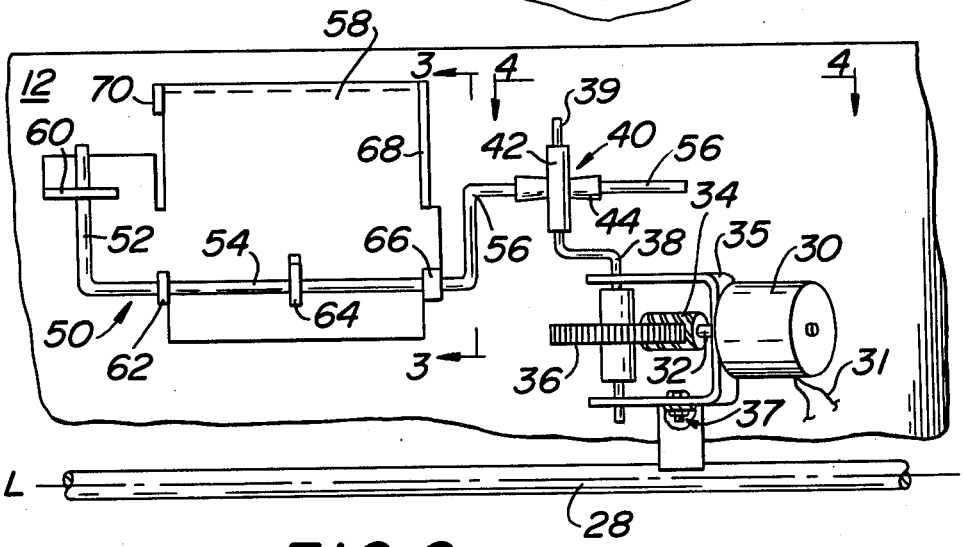
FIG. 2

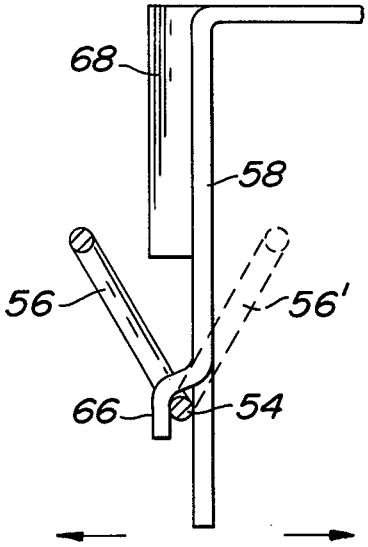
FIG. 3
FIG. 4
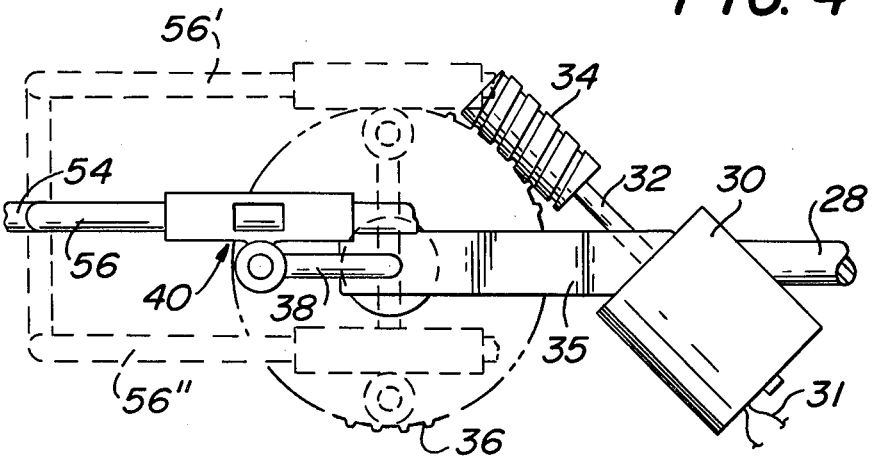

BATTERY-OPERATED CHILD'S SWING

BACKGROUND OF THE INVENTION

This invention relates to children's swings, especially battery-operated swings for infants.

Swings for children are well-known, and range from a simple used automobile tire suspended from a tree branch to much more sophistocated models. Non-electric swings have been patented in the United States, as well as a number of AC motor-operated swings. However, AC motor-operated swings are undesirable for children's use for a number of reasons. Because they operate off a standard AC line, they involve higher voltages than are desirable where children are concerned. Furthermore, being AC driven, such a swing requires line cords, which limit its portability and present hazards to children running or walking in the vicinity. Moreover, the use of an AC motor sufficient to drive the swing adds considerable weight to the item, thereby increasing its manufacturing and shipping costs and making it generally inconvenient to handle. The use of an AC motor does not lend itself well to sales of the item in "knock-down" form, where the item is sold for ultimate assembly in the home by the consumer. Thus, there is a real need for children's swings which are battery-operated and which operate at low voltages and are therefore lighter in weight and safer for children's use.

It is also desireable to provide a child's swing which is resistant to damage inflicted upon it intentionally or inadvertently by its young users. If the swing drive is rigidly coupled to the carriage, stoppage of the motor (for example, due to battery failure) while the carriage is swinging, or, conversely, stoppage of the carriage while the motor is still energized, will put a severe strain on the linkage between the drive motor and the carriage, more often than not causing the moter to stall and burn out. When this happens, the swing is virtually useless to the consumer, since the cost of repair can be almost as great as the cost of a new swing, or since such swings are so constructed as to be almost impossible to repair.

Accordingly, it is an object of the instant invention to eliminate these drawbacks by providing a battery-operated child's swing which operates at low voltages, is simpler in construction than comparable swings, utilizes a very inexpensive small DC motor to drive the swing, is not disturbed by stoppage of the swing or the motor, does not require electric wires, and is not easily damaged by intentional or unintentional abuse from its young users.

SUMMARY OF THE INVENTION

The present invention is a child's swing or the like of the type having a supporting frame and a horizontal pendulum axle journaled in the frame and from which a seat is suspended. A motor is mounted on the horizontal pendulum axle for movement with the axle. A crank means is mounted on the axle for movement with the axle, and is driven for rotation with respect to the axle by the motor. A torsional spring means is fixedly mounted with respect to the frame. The spring means is in spaced relation to the axis of the horizontal pendulum axle and is substantially parallel to it. A sleding coupling means couples the crank means to the torsional spring means. Rotation of the crank means imparts a force to the torsional spring means through the coupling means, resulting in a force moment about the axis of the horizontal pendulum axle. The force moment causes the axle to rotate about its axis, thereby causing the seat to swing.

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

FIG. 1 is a perspective view of a swing in accordance with the present invention.

FIG. 2 illustrates the swing drive mechanism incorporating the 2-way slider and the over-travel torque spring.

FIG. 3 is a sectional view taken along the lines 3—3 in FIG. 2.

FIG. 4 is a sectional view taken along the lines 4—4 in FIG. 2.

Figure 6:
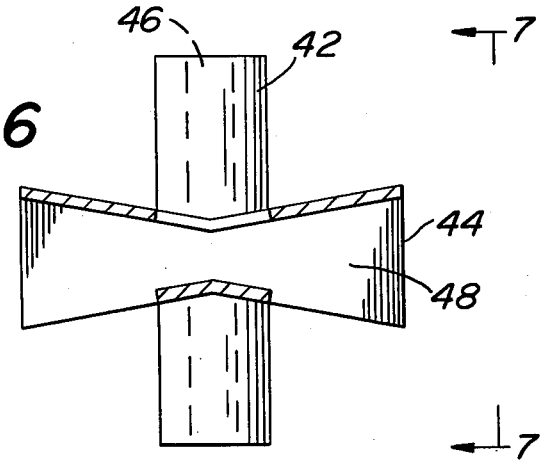
FIG. 6 is a sectional view taken along the lines 6—6 in FIG. 5.
Figure 7:
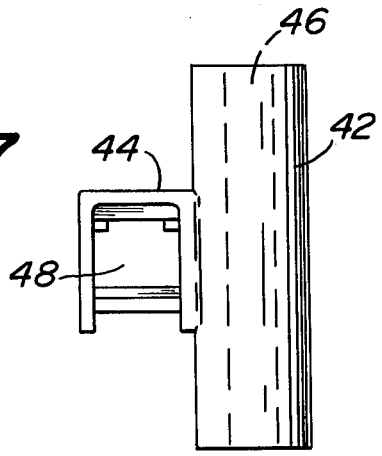

FIG. 7 a side view taken along the lines 7—7 in FIG. 6.

DETAILED DESCRIPTION OF THE INVENTION

Referring now to the drawings, wherein like numerals indicate like elements, there is shown in FIG. 1 a swing 10 in accordance with the present invention. The swing drive mechanism, shown in phantom lines in FIG. 1, is contained within a housing 12, which may be formed of sheet metal or may be injection molded plastic. Any suitable material or configuration of housing may be used. The housing is supported by two pairs of standards 14, 16 and 14', 16'. Braces 18, 18' are mounted transversely between standards 14, 16 and 14', 16', repectively, and serve to give strength and stability to the swing. Standards 14, 16 and 14', 16' along with housing 12, define a supporting frame. A swing seat 20, which may be made of cloth or injection molded plastic, is suspended between pairs of standards 14, 16 and 14', 16' from pivot bar 28, shown in phantom in FIG. 1. Seat 20 is suspended by hangers 22, 24, and 22', 24', which are attached to pivot bar 28 at locations 26 and 26' respectively. Seat 20 and hangers 22, 24 and 22', 24' form a swing carriage. Pivot bar 28 is journaled in suitable bearings (not shown) within housing 12.

As best seen in FIG. 2, a motor 30 is mounted on pivot bar 28 by any suitable means (not shown), such as a bracket or other support. The motor is preferably a DC electric motor, but may be any suitable motor. Wires 31 are provided to connect motor 30 with a battery (not shown), which is the source of electric current for motor 30.

Motor 30 has a co-axial drive shaft 32 on which is mounted worm 34. See FIG. 4. Worm 34 meshes with gear 36, which is journaled in bracket 35. Bracket 35 is fixedly mounted on pivot bar 28, such as by rivet 37 or by any other suitable means. See FIG. 2. Crank 38 is fixedly mounted to gear 36. It can be seen that, when motor 30 is energized, drive shaft 32 rotates, driving crank 38 through gear 36 and worm 34.

Figure 5:
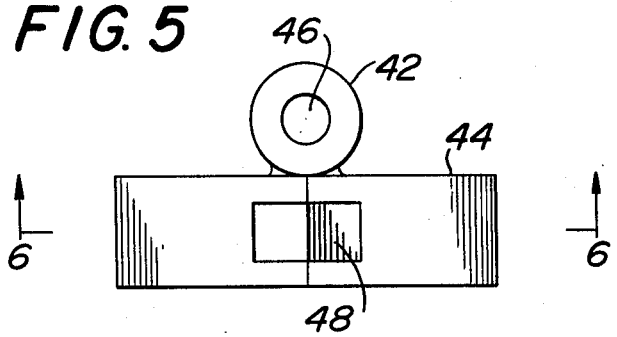
FIG. 5 is a plan view of the 2-way slider.

The extreme end 39 of crank 38 is journaled for relative rotation therewith in sleeve 42 of two-way slider 40. Sleeve 42 is provided with an axial bore 46 for receiving end 39 of crank 38. See FIG. 5. Integral with sleeve 42 and mounted at right angles to it is sleeve 44, which receives the driven end 56 of overtravel torque spring 50 for relative longitudinal moement therewith. Sleeve 44 is provided with an axial bore 48 for receiving driven end 56.

Over-travel torque spring 50 is mounted on mounting bracket 58, which is secured to housing 12. Mounting bracket 58 may be secured in any suitable fashion, so long as it is fixed with respect to the swing frame. Mounting bracket 58 is provided with struckout portions 60, 62, 64 and 66, which serve to secure torque spring 50. See FIG. 2. Torque spring 50 has a fixed end 52 which passes between struck out portion 60 and bracket 58. Torque spring 50 also has a torsion section 54 which passes between mounting bracket 58 and struckout portions 62, 64 and 66. See FIGS. 2 and 3. Mounting bracket 58 is also provided with flanges 68 and 70, which serve to give mounting bracket 58 strength and rigidity.

It will be observed that when motor 30 is energized and crank 38 is turned, crank 38 imparts a side force to the driven end 56 of torque spring 50 via two-way slider 40. The side force is directed first toward the front of the swing and then toward the rear of the swing. Reference should be made to FIG. 4, which shows the driven end 56 of torque spring 50 in the intermediate position (shown in solid lines) and at the front and rear extremes (shown in phantom). This side force is transmitted to pivot bar 28 through bracket 35, which is fixedly mounted thereon. Since, as shown in FIG. 2, the drive mechanism is mounted above pivot bar 28, this side force is necessarily applied above horizontal pivot line L. Thus, there is created a force moment about pivot bar 28, which causes pivot bar 28 to rotate about its axis, thereby imparting a swinging motion to the swing carriage.

Over-travel torque spring 50 is made of material which is stiff enough to transmit the driving force from the crank to the swing carriage while being resilient enough to twist to follow the motion of the crank. As shown in FIG. 4, and as already described, when crank 38 turns, it imparts a side force on driven end 56 of torque spring 50. Torsion section 54 of torque spring 50 twists to enable driven section 56 to move to its maximum rearward position, shown in phantom in FIG. 4 as 56', through the intermediate position to the fully forward position, shown in phantom as 56". The resiliency of torque spring 50 also serves to decouple crank 38 from motion of the swing carriage in the event of a stoppage of motor 30 while the carriage is still swinging. In such an event, all of the swing energy will go into twisting torsion section 54 of torque spring 50 rather than motor shaft 32. Thus, the entire drive mechanism is sufficiently resilient to resist damage in the event motor 30 stops while the swing is in use.

It can be seen that the instant invention eliminates the problems associated with prior art swings. By using a battery as the source of power, line cords and AC voltages are avoided. Moreover, use of the two-way slider and over-travel torque spring provides a drive mechanism which is resistant to hard use or abuse.

The present invention may be embodied in other specific forms without departing from the spirit or essential attributes thereof and, accordingly, reference should be made to the appended claims, rather than to the foregoing specification, as indicating the scope of the invention.

I claim:

1. In a child's swing or the like which includes a supporting frame and a horizontal pendulum axle journaled in the frame and from which a seat is suspended, the combination comprising:

(a) a motor mounted on the horizontal pendulum axle for movement therewith, (b) crank means mounted on the horizontal pendulum axle for movement therewith, the crank means being driven for rotation with respect to the pendulum axle by the motor, (c) torsional spring means fixedly mounted with respect to the frame, the spring means being in spaced relation to the axis of the horizontal pendulum axle and substantially parallel to the axis, and (d) sliding coupling means for coupling the crank means to the torsional spring means, whereby rotation of the crank means imparts a force to the torsional spring means through the coupling means resulting in a force moment about the axis of the horizontal pendulum axle, causing the axle to rotate about its axis, thereby causing the seat to swing.

2. The combination according to claim 1, wherein the motor is an electric motor.

3. The combination according to claim 2, wherein the motor is energizable by direct current.

4. The combination according to claim 3, wherein the motor is energized by a battery.

5. The combination according to claim 1, wherein the crank means is mounted above the pendulum axle.

6. The combination according to claim 1, wherein the torsional spring means is made of metal.

7. The combination according to either of claims 1 or 6, wherein the torsional spring means has a first end fixed to the supporting frame and a second end which slideably engages the sliding coupling means.

8. The combination according to claim 7, wherein the torsional spring means includes a torsion section between the first and second ends which twists to permit the second end to move in an arcuate path in reciprocal fashion with respect to the first end.

9. The combination according to claim 1, wherein the torsional spring end that engages the slider is located above the axis of the horizontal pendulum axle.

10. The combination according to claim 1, wherein the crank means is mounted on a gear driven by a worm mounted on the motor shaft which meshes with the gear, the axis of the gear being substantially perpendicular to the axis of the worm.

11. In a child's swing or the like which includes a supporting frame and a horizontal pendulum axle journaled in the frame and from which a seat is suspended, the combination comprising:

(a) a direct-current electric motor mounted on the horizontal pendulum axle for movement therewith, (b) a battery connected to the motor to energize the motor, (c) crank means mounted on the horizontal pendulum axle for movement therewith, the crank means being mounted on a gear and driven for rotation with respect to the pendulum axle by the motor through a worm mounted on the motor shaft which meshes with the gear, the axis of the gear being substantially perpendicular to the axis of the worm, (d) torsional spring means fixedly mounted with respect to the frame, the spring means being substantially parallel to the axis and having a first end fixed to the supporting frame, a second end, and a torsion section between the first and second ends which twists to permit the second end to move in an arcuate path in reciprocal fashion with respect to the first end, and (e) sliding coupling means for coupling the crank means to the second end of the torsional spring means, whereby rotation of the crank means imparts a force to the torsional spring means through the coupling means resulting in a force moment about the axis of the horizontal pendulum axle, causing the axle to rotate about its axis, thereby causing the seat to swing.

12. The combination according to claim 11, wherein the, crank means is mounted above the pendulum axle.

* * * * *